United States Patent [19]

Parks, Jr. et al.

[11] 4,293,115

[45] Oct. 6, 1981

[54] TESTING MECHANISM FOR BLOWOUT PREVENTER RAM LOCK

[75] Inventors: Glenn C. Parks, Jr.; Clark W. Beam, both of Houston, Tex.

[73] Assignee: Hydril Company, Houston, Tex.

[21] Appl. No.: 78,092

[22] Filed: Sep. 24, 1979

[51] Int. Cl.[3] ..... E21B 33/06; F15B 15/26

[52] U.S. Cl. ..... 251/1 A; 92/17; 92/24

[58] Field of Search ..... 251/1 R, 1 A; 92/24, 92/27, 15, 32, 17

[56] References Cited

U.S. PATENT DOCUMENTS

| | | | |
|---|---|---|---|
| 2,019,163 | 10/1935 | Slater | 92/32 |
| 2,092,530 | 9/1937 | Curtis | 92/32 |
| 2,251,269 | 8/1941 | Curtis | 92/32 |
| 3,182,566 | 5/1965 | Berg et al. | 92/24 |
| 3,208,357 | 9/1965 | Allen et al. | 251/1 A |
| 3,242,826 | 3/1966 | Smith | 92/24 |
| 3,578,783 | 5/1971 | Loustalet et al. | 92/15 |
| 4,052,995 | 10/1977 | Ellison | 251/1 A |
| 4,076,208 | 2/1978 | Olson | 251/1 A |

*Primary Examiner*—Martin P. Schwadron
*Assistant Examiner*—A. Michael Chambers
*Attorney, Agent, or Firm*—Pravel, Gambrell, Hewitt, Kirk, Kimball & Dodge

[57] ABSTRACT

A testing mechanism for a ram lock for blowout preventer rams which permits testing of lock mechanism by overriding the automatic unlocking capability of the mechanism.

8 Claims, 4 Drawing Figures

TESTING MECHANISM FOR BLOWOUT PREVENTER RAM LOCK

FIELD OF INVENTION

The present invention relates to locks for blowout preventer rams.

REFERENCE TO CO-PENDING APPLICATIONS

The present application relates to a testing mechanism for the blowout preventer ram lock of U.S. Patent Application Ser. No. 078093, filed of even date herewith and assigned to the assignee of the present invention.

DESCRIPTION OF THE PRIOR ART

In ram blowout preventers, each closure of the ram causes a certain amount of wear of the ram sealing elements which move into the borehole of the preventer for sealing contact with a pipe or other object, such as another ram. During succeeding closures of the rams, the effectiveness of the seal was reduced when the ram was locked in sealing position due to such wear.

Certain prior art blowout preventer ram locks, such as in U.S. Pat. Nos. 3,242,826 and Re 27,294, used snap rings or collets mounted with a ram piston for locking. When the piston reached a predetermined locking position defined by a groove in the ram piston cylinder, the snap ring moved into the groove to lock the ram and piston in place. However, with this structure, only one locking position of the ram, as defined by the relative position of the snap ring and groove, was obtained. Change of the locking position to compensate for sealing element wear required adjustment of the relative positions of the locking elements, requiring undesirable disassembly of the blowout preventer cylinders for such adjustment to be made.

Other blowout preventer ram locks, such as in U.S. Pat. No. 3,208,357, used a tapered locking pin which moved into locking position behind the ram piston once the ram had been moved into sealing position. However, extra hydraulic operating and control lines, separate and distinct from those for causing ram piston movement, were required, increasing the complexity of the control system for those types of ram locks.

In U.S. Pat. No. 4,052,995 assigned to the assignee of the present application, these shortcomings have been for the most part overcome. However, locking action in this patent was based on frictional engagement of locking rings in locking position. For high loads, however, this frictional engagement could be subject to slippage. In certain instances, unlocking of the frictionally engaging locking structure could cause difficulties. Also, dirt or particles in the operating fluid could cause galling of the frictionally engaging locking surfaces.

U.S. Pat. No. 4,076,208, which is also assigned to the assignee of the present application, afforded certain improvements over the foregoing prior art. However, a separate piston was required for the sole purpose of disengaging a clutch to permit unlocking of the ram, adding several parts to the lock and requiring a system of fluid passages to port fluid for unlocking. Seals required for this fluid porting system for unlocking created several potential leak paths, the leakage of any of which could cause failure of the blowout preventer.

In the co-pending U.S. Patent Application referred to above, the ram lock is normally biased by resilient means to cause ratchet teeth to lock at various positions during inward movement of the ram carrier and rams. An unlocking mechanism in the form of a movable cylinder sleeve responds to the pressurized fluid introduced to move the rams to an open position and unlocks the ram lock. At certain times, however, it has been desirable to test the lock mechanism by overriding the normal tendency to unlock when opening pressure is applied.

SUMMARY OF INVENTION

Briefly, the present application provides a new and improved testing mechanism for a ram lock for blowout preventer rams. The lock is of the type which automatically locks the ram against outward movement during inward movement of the ram to a closed position in a bore of the blowout preventer, and further locks the ram at an adjustable closed position to achieve the desired degree of sealing contact with a well pipe or like object in the bore. The ram lock of the present invention further automatically unlocks the ram and permits opening thereof in response to opening fluid pressure.

A ram carrier moves through a cylinder of the blowout preventer in response to pressurized fluid to move the ram through the blowout preventer to and from the desired closed position. The ram carrier moves in the preventer in response to opening and closing fluid pressures and has a threaded surface which continuously engages a similar threaded surface on a lock nut rotatably moving with respect to the ram carrier. The lock nut also includes a fixed clutch plate, having ratchet teeth, which is fixedly mounted with and moved with the lock nut. A movable clutch plate having ratchet teeth adapted to move into engagement with the ratchet teeth of the fixed clutch plate is mounted with the blowout preventer. The ratchet teeth are normally urged into engagement to lock the ram carrier against outward movement.

A cylinder receives the opening and closing fluid pressures to operate against the ram piston to cause movement of the ram to and from the closed positions, respectively. A cylinder sleeve mounted within the cylinder responds to opening fluid pressure and disables the mechanism which normally urges the ratchet teeth into locking engagement and automatically unlocks the ram lock. The cylinder sleeve further has an annular shoulder formed about the periphery thereof at a selected position along its length.

The testing mechanism of the present invention includes a locking pin or plug adapted to move inwardly into the cylinder of the blowout preventer to engage the cylinder sleeve and prevent the cylinder sleeve from unlocking the lock during testing.

DESCRIPTION OF PREFERRED EMBODIMENT

Figures 1, 3, 4:
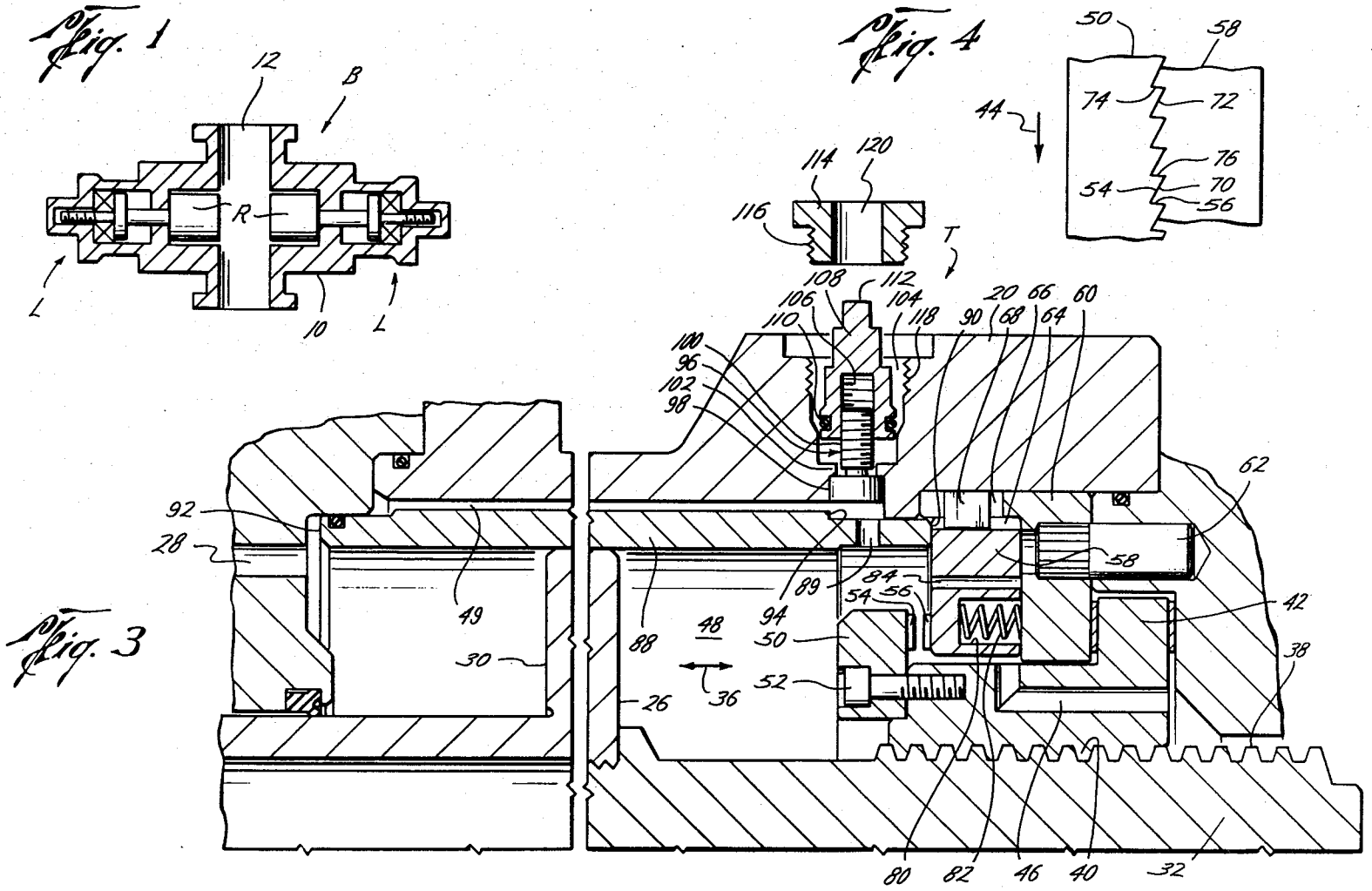
FIG. 1 is a vertical sectional view of a ram blowout preventer according to the present invention.
FIG. 3 is a vertical sectional view, partially disassembled of the blowout preventer of FIG. 2 in a partially open position.
FIG. 4 is an elevation view of ratchet teeth of the lock of the present invention.

In the drawings, the letter B (FIG. 1) refers generally to a blowout preventer of this invention which is formed with a pair of rams R which are locked into place by a locking apparatus L of the present invention automatically and at adjustable closed positions for sealing contact with a well pipe or like object. The blowout preventer B is typically mounted in a stack of blowout preventers or in a string of well casing or pipe. A testing mechanism T is provided to permit the lock L and blowout preventer B to be tested by overriding the normal tendency to unlock when opening pressure is applied.

As is conventional, the rams R are disposed in a conventional blowout preventer body or housing 10 having a longitudinal well bore 12 formed therethrough, through which well pipe or other objects such as well tools may pass in normal operations conducted with the blowout preventer B in an open or retracted position (FIG. 1). In the open position, the rams R are mounted in conventional recesses in the body 10 adjacent the bore 12. The rams R move in response to a motive or power means M from their respective recesses into an extended or closed position in the bore 12 for sealing contact of conventional sealing elements with a well pipe, well tool or another ram. The sealing elements of the ram are conventional and are carried by the ram R. Since the sealing elements and rams blocks are conventional, they are not shown in the drawings in order to more clearly show other structure.

The rams R may be any of several types of blowout preventer rams. For example, the rams R may be of the type known as a "blind" ram for sealing against another "blind" ram of similar structure; the type wherein the sealing inner portions of the rams are shaped for sealing about a pipe or well tool in the bore, as well as with one another on each side of the pipe or well tool; or the shear-seal ram type for shearing tubing or objects in the bore 12 in conjunction with a similar shear-seal ram and thereafter sealing the bore 12 of the preventer B against well pressure.

A conventional head or bonnet 14 (FIG. 2) is connected to each side of the body or housing 10 and each of such heads or bonnets has a conventional recess 15 aligned with the recesses in the housing or body 10 so that the rams R may be received in such recesses when they are in the retracted or open position (FIG. 1). A piston rod 16 (FIG. 2) extends through suitable sealing structure in an opening 15 of each head or bonnet 14. Each piston rod 16 extends to a piston 18 of conventional construction which is disposed in a cylinder 20 with O-rings 22 or other suitable seals therebetween. The piston 18 moves in response to the motive means M within the cylinder 20 in a manner to be set forth. Suitable fluid seals are provided in the connection between the cylinder 20 and bonnet 14.

The cylinder 20 is mounted with the bonnet 14 by bolts 21 or other suitable fastening means. Similarly, a cylinder head cap or end closure 24 is mounted to the cylinder 20 by conventional bolts 25 or other suitable fastening means with suitable seals between the head cap 24 and cylinder 20.

For purposes of illustration in the preferred embodiment, the motive means M includes a suitable fluid inlet line formed in the head cap 24 or elsewhere for introducing air, hydraulic fluid or other operating fluid pressure into the head cap 24 and cylinder 20 against an outer surface 26 of the piston 18 for moving the piston 18 inwardly (to the left as viewed in FIGS. 2 and 3) to move the rams R toward the center of the bore 12. An opening fluid conduit 28 is formed through the body of the bonnet 14 for introducing air, hydraulic fluid or other operating fluid pressure into structure within the cylinder 20 against an inner surface 30 (FIG. 2) of the piston 18 for moving the piston 18 outwardly (to the right as viewed in FIGS. 2 and 3) to retract the ram R from the closed position in the bore 12.

It should be understood that various systems for providing operating or motive power to the blowout preventer B may be employed and the invention is not limited to the specific form illustrated in the drawings. It should also be understood that a similar power means is provided for the left-hand ram R as viewed at FIG. 1 in the same manner as the power means M illustrated for the right-hand ram R in FIG. 2.

Considering now the lock L, a piston tail shaft or rod 32 of the ram carrier extends rearwardly from the piston 18 and moves into and out of an opening 34 in the cylinder head cap 24, as the piston 18 (FIG. 3) moves transversely inwardly and outwardly (as indicated by an arrow 36) with respect to the bonnet 14 in response to the power means M. The piston tail rod 32 has a threaded external surface 38 formed thereon which is continuously engaged with a threaded inner surface 40 of a lock nut 42 of the lock L.

The threaded surfaces 38 and 40 are in the form of multistart helical threads which in response to fluid pressure converts transverse movement of the piston tail shaft 32 to rotational movement of the lock nut 42. An eight-start thread may be used, if desired, although it should be understood that helical threads having other numbers of start may be used as well.

The threaded surface 38 of the tail shaft 32 and threaded surface 40 of the lock nut 42 engage so that the lock nut 42 rotates in a clockwise direction (viewing the lock L from the direction of the ram R) as indicated by an arrow 44 in FIG. 4) in response to inward movement of the piston 18. As will be set forth below, the lock L restrains rearward movement of the piston 18 until unlocked, at which time the threaded surfaces 38 and 40 cause the lock nut 42 to move in a reverse or counterclockwise direction in response to outward movement of the piston 18. Suitable bearing surfaces are provided between the lock nut 42, cup member 60, and head cap 24 to reduce friction during relative movement therebetween.

It is to be noted that the piston 18 and tail shaft 32 do not rotate with respect to the cylinder 20 or bonnet 14 during inward or outward movement. When the lock L is disengaged, the lock nut 42 rotates with respect to the tail shaft 32 in the manner set forth above. When engaged, the lock L restrains rearward movement of the ram carrier.

A fluid conduit 46 is formed in the lock nut 42 to provide fluid communication between the interior space 34 in the head cap 24 and a space or opening 48 (FIG. 2) and an annular space 49 within the cylinder 20.

The lock L further includes a clutch plate 50 mounted with the lock nut 42 by means of bolts 52 or other suitable connecting means so that the clutch plate 50 moves along with the lock nut 42 with respect to the tail shaft 32 during inward and outward movement of the ram R.

The clutch plate 50 has ratchet teeth 54 (FIG. 4) formed on a rear surface thereof which are selectively engageable, in a manner to be set forth, with opposing ratchet teeth 56 of a body clutch plate 58. The body clutch plate 58 is mounted within a cup member 60 which is mounted to the cylinder head cap 24 by pins 62 or other suitable mounting means. The cup member 60 may be integrally formed with the cylinder head cap 24, if desired. The body clutch plate 58 has grooves 64 (FIG. 3) formed therein adjacent to corresponding grooves or slots 66 in cup member 60 so that keys 68 may be inserted to interconnect the cup member 60 and clutch plate 58 to prevent relative rotational movement therebetween while allowing relative transverse movement.

Each of the ratchet teeth 54 on the clutch plate 50 has a sloping ramp surface 70 (FIG. 4) formed thereon which contacts a conforming sloping ramp surface 72 of corresponding teeth 56 on the body clutch plate 58. Each of the ratchet teeth 54 and 56 further has a planar stop surface 74 and 76 respectively, formed between their adjacent ramp surfaces 70 and 72.

The clutch plate 50 is mounted with the lock nut 42, as has been set forth, and the engaged sloping ramp surfaces 70 and 72 of the ratchet teeth permit the clutch plate 50 to move clockwise therewith, as indicated by the arrow 44 (FIG. 4) when the piston 18 is moving inwardly.

The body clutch plate 58 has a suitable number of sockets 80 formed therein facing the cup member 60 for receiving springs 82 or other suitable resilient means. The springs 82 move the body clutch plate 58 outwardly to a position where the ratchet teeth 54 and 56 are normally engaged (FIG. 4). A fluid port 84 is formed in the body clutch plate 58 to facilitate passage of pressurized fluid from the cylinder head 24 into the spaces 48 and 49.

The locking mechanism L further includes a cylinder sleeve 88 mounted within the bonnet 14 and receiving the piston 18 therein for guiding the piston 18 during inward and outward movement. The cylinder sleeve 88 has a surface 90 formed on an outer surface which also responds to pressurized fluid applied against the surface 26 of the piston 18 and moves the liner 88 out of contact with the body clutch plate 58, permitting the springs 82 to move the ratchet teeth 54 and 56 into engagement.

During the inward movement of the piston 18, closing fluid pressure is admitted into interior space 48 against surface 26 of the piston 18. As has been set forth, this fluid pressure also acts on the cylinder sleeve 88 moving such sleeve out of contact with the clutch plate 58 to permit the spring 82 to urge the ratchet teeth 54 and 56 of the lock L into engagement. In this manner, the ram R is locked against rearward movement, which might be caused by forces such as well bore pressures and the like.

The ratchet teeth 54 and 56 are maintained in engagement by the force of the springs 82. In the locking position of lock L, the clutch plate 50 moves with the lock nut 42 during inward movement of the piston 18. The resilient springs 82, however, yield sufficiently to permit relative ratcheting movement between the ratchet teeth 54 of clutch plate 50 and the ratchet teeth 56 of the body clutch plate 58 as the piston 18 moves inwardly.

The cylinder sleeve 88 further has an inner annular surface 92 which responds to opening fluid pressure into the cylinder 20 by way of the opening fluid conduit 28 against the surface 30 of the piston 18. An O-ring or other suitable seal is mounted about an outer surface at an inner portion of the sleeve 88 to provide a seal between opening and closing pressure. A port 89 is formed in the sleeve 88 to permit fluid communication between the space 34, the space 48 and the annular space 49 between cylinder 20 and sleeve 88.

On receipt of opening fluid pressure on the surface 92, the cylinder sleeve 88 moves rearwardly until the surface 90 thereof contacts the body clutch plate 58 and moves the clutch plate 58 rearwardly, overcoming the force exerted by the springs 82. In such a position (FIG. 3), the ratchet teeth 54 and 56 are out of contact with each other, and the locking mechanism L is unlocked. THe threaded surface 38 of the tail shaft 32 is permitted to pass rearwardly through the surface of the lock nut 42, with the lock nut 42 and clutch plate 50 rotating in the reverse direction to the arrow 44 (FIG. 4). In addition, an annular shoulder 94 is formed about the periphery of the cylinder sleeve 88 at a selected location along its length, such as at a rear location as shown in the drawings.

Considering now the testing mechanism T in detail (FIG. 3), a locking pin or plug 96 having a lower engaging member 98 and a threaded upper connector member 100 connected by a neck portion 102 is mounted in a passage 104 formed extending through the cylinder 20. The locking pin or plug 96 is mounted at its connector member 100 with a threaded inner tapped socket 106 of a tapped bolt 108. The bolt 108 has an O-ring or other suitable sealing means 110 mounted therewith to seal the passage 104 and prevent pressurized fluid from escaping from the cylinder 20. At an upper portion of the tapped bolt 108 a head member 112 is formed having square, rectangular hexagonal or other suitable configuration to be engaged by a wrench or the like.

A locking gland 114 has a threaded surface 116 for engaging a similar threaded surface 118 formed in the cylinder 20 and retains the bolt 108 and plug 96 of the testing mechanism T in position. The locking gland 114 has an opening or passage 120 formed therethrough so that the head member 112 is accessible externally of the cylinder 20.

The bolt 108 rotates in response to engagement and movement of the head member 112 by a wrench or the like and causes relative movement between the threaded socket 106 thereof and the connector member 100 to cause relative inward and outward movement, as desired, of the engaging member 98 from a test position contacting the shoulder 94 of cylinder sleeve 88 (FIG. 2) to a recessed position (FIG. 3) where movement of the cylinder sleeve 88 to unlock the lock L is unimpaired. In the test position (FIG. 2), the head member 112 extends outwardly from the cylinder 20 to provide a visual indication that the testing mechanism T is engaged.

It should be understood that, if desired, two or more testing mechanisms T may be provided in the cylinder 20 at various positions about its periphery to engage the shoulder 94 of cylinder sleeve 88 and prevent unlocking of the lock L. It should also be understood that a lock L and testing mechanism T are provided for the left-hand ram R as viewed in FIG. 1 in the same manner as the lock L and test mechanism T discussed above for the right-hand ram R in FIG. 2.

In the operation of the blowout preventer B with the lock L, when it is desired to move the ram R inwardly from the open position (FIG. 1) to the closed position (FIG. 3), operating fluid pressure is provided through suitable fluid inlets into interior space 48 to act on the ram piston 18 and move the ram R inwardly. The operating fluid introduced also moves the cylinder sleeve 88 out of contact with the body clutch plate 58, permitting the ratchet teeth 54 and 56 of the locking mechansim L to engage in response to the springs 82. Engagement of the ratchet teeth 54 and 56 in the locking position occurs during initial stages of inward movement of the piston 18 from the open position.

With the ratchet teeth 56 of clutch plate 58 moved into the locking position (FIG. 4) with the ratchet teeth 54 of the clutch plate 50 from the outset of inward movement of the piston 18, contact is maintained between the ratchet teeth 54 and 56 by the springs 82. In this manner, during all stages of inward advance of the piston 18 with respect to the bore 12 of the preventer B, the lock nut 42 freely rides and rotates with respect to the piston tail shaft 32 permitting continuous inward advance of the ram R due to the relative movement of the sloped ratchet teeth 54 and 56 permitted by the springs 82.

However, at substantially all positions of the ram R with respect to the bore 12 during such inward movement, the ratchet teeth 54 and 56 are engaged and locked against any rearward force on the piston 18, locking so that the ram R is locked and restrained against such rearward movement. In this manner, the lock L automatically locks the ram carrier and the ram R against rearward movement at any position during inward movement thereof.

Further, once the ram R has reached an initial sealing position contacting a well pipe or other object in the bore 12 of the preventer B, it is possible to compensate for wear of the blowout preventer sealing elements, typically elastomer or other sealing material. Once the initial closed position has been reached with the ram forcing the ram sealing elements into an initial seal with the object in the bore 12, increased pressure is introduced to act on the ram piston 18 and move the piston 18 and ram R further inwardly. The ram R is moved further inwardly in this manner with the ram forcing the sealing elements thereof into closer engagement with the object in the bore 12 increasing the feed of the sealing elements into contact with the object to compensate for any wear or loss of the sealing elements until the desired degree of sealing contact between the object in the bore and the ram R is obtained. It is to be noted that with the ratcheting clutch plate feature of the locking mechanism L, the lock position of ram R is varied over a wide range of positions to achieve the desired seal in contrast to a limited number of fixed positions. It is further to be noted that automatic mechanical locking of the lock L is maintained during movement of the ram R to the required closed position.

Once the ram R is in the desired sealing position, the pressure of the operating fluid may be abated and the ram R remains locked in the sealed position automatically by the lock L due to the locking engagement of the ratchet teeth 54 and 56, forming a locking connection between the ram R and the remainder of the blowout preventer B.

Figure 2:
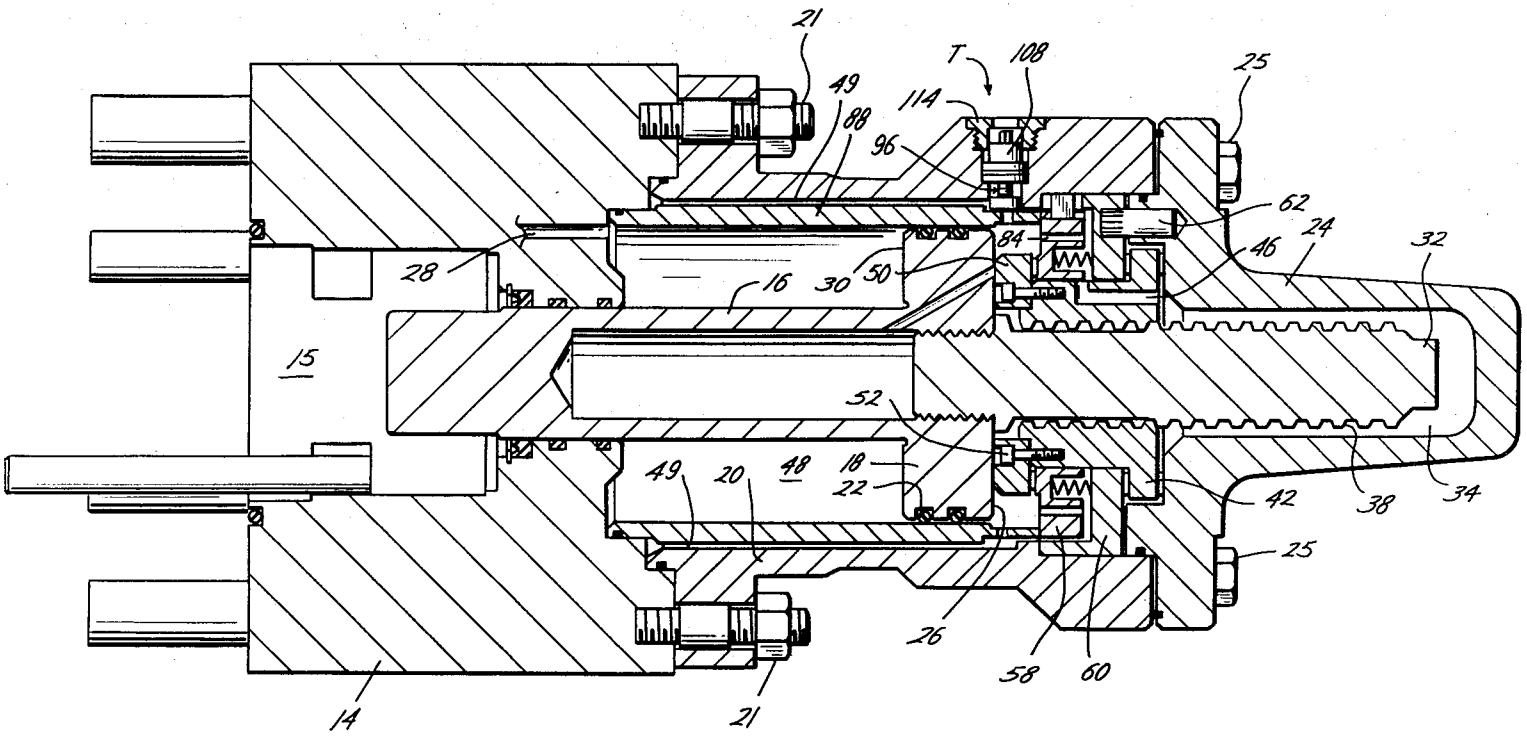
FIG. 2 is a vertical sectional view of a ram blowout preventer and lock of the present invention in an open position.

At times, it is desirable to test the operation of the locking mechanism L, such as pressurized fluid conduits and the like, as well as other portions, without disabling the lock L. At such times, the bolt 108 is engaged and the engaging member 98 moved from the recessed position (FIG. 3) to a position contacting the shoulder 94 of the cylinder sleeve 88 (FIG. 2). The locking mechanism L may then be tested, and the engaging member 98 of the testing mechanism T prevents rearward movement of the cylinder sleeve 88, preventing the sleeve 88 from unlocking the locking mechanism L. When the test mechanism T is not required, engaging member 98 may be moved to the recessed position by bolt 108.

When it becomes desirable or necessary to unlock the ram R from the adjustable closed position, the testing mechanism T is moved to the recessed position if it is not already so located. Suitable unlocking fluid pressure is provided through the opening fluid inlet 28. The fluid pressure through the inlet 28 acts on the inner surface 30 of the piston 18 to move such piston and the ram R rearwardly with respect to the blowout preventer B. Further, the fluid pressure concurrently acts on the surface 92 of cylinder sleeve 88 moving the cylinder sleeve surface 90 into engagement with the clutch plate 58 and causing the ratchet teeth 54 and 56 to move out of engagement, unlocking the lock L in order to permit rearward movement of the piston 18.

The foregoing disclosure and description of the invention are illustrative and explanatory thereof and various changes in the size, shape and materials as well as in the details of the preferred embodiment may be made without departing from the spirit of the invention.

We claim:

1. In a blowout preventer having at least one blowout preventer ram movable therein to adjustable closed positions for sealing contact with a well pipe or the like in a bore of the blowout preventer, and having a ram lock comprising:

(a) ram carrier means comprising a ram piston having a piston rod with a threaded surface formed thereon for moving the ram to the adjustable closed positions in the blowout preventer;

(b) cylinder means for receiving opening and closing fluid pressures to operate against said piston to move the ram to and from open and closed positions, respectively;

(c) lock means for locking said ram carrier means at the closed positions, comprising:

(1) a lock nut having a threaded surface formed thereon and engaged by said threaded surface on said ram piston tail shaft for rotational movement with respect thereto during movement of the ram;

(2) a ram carrier clutch plate mounted with said lock nut for rotational movement therewith, said clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said lock nut clutch plate into engagement to lock said ram carrier means; and (e) means for unlocking comprising cylinder sleeve means mounted in said cylinder enclosing said piston of said ram carrier means;

(f) said cylinder sleeve means including surface means responding to the opening fluid pressure to engage said body clutch plate to disable said means for urging and unlock said ram lock;

(g) the improvement comprising locking plug means for locking said cylinder sleeve means to permit testing of said lock means without allowing said lock means to become unlocked.

2. The structure of claim 1, wherein:

(a) said cylinder sleeve means has a shoulder formed about the periphery thereof; and (b) said locking plug means comprises means for selectively engaging said shoulder of said cylinder sleeve means.

3. The structure of claim 2, wherein said means for selectively engaging comprises: means for moving said locking plug means to and from a piston of engaging said shoulder of said cylinder sleeve means.

4. The structure of claim 3, further including:

means for mounting said locking plug means and said means for moving with said cylinder means.

5. The structure of claim 3, wherein said means for moving comprises:

means connected with said locking plug means for causing relative rotational movement thereof.

6. The structure of claim 3, wherein said locking plug means has a threaded connector member and said means for moving comprises:

tapped bolt means having a threaded connector member for engaging said threaded connector member of said locking plug means.

7. The structure of claim 1, further including:

means for providing a visual indication that said locking plug means is engaged.

8. The structure of claim 1, wherein the preventer has at least a pair of rams, and wherein each of the rams has a ram lock for locking the ram at an adjustable closed position for sealing contact with a well pipe or the like in a bore of the blowout preventer, comprising:

(a) ram carrier means comprising a piston, a piston rod, and a piston tail shaft with a threaded surface formed thereon for moving the ram to the adjustable closed positions in the blowout preventer;

(b) cylinder means for receiving opening and closing fluid pressures to operate against said piston to move the ram to and from open and closed positions, respectively;

(c) lock means for locking said ram carrier means at the closed positions, comprising:

(1) a lock nut having a threaded surface formed thereon and engaged by said threaded surface on said ram piston tail shaft for rotational movement with respect thereto during movement of the ram;

(2) a clutch plate mounted with said lock nut for rotational movement therewith, said clutch plate having ratchet teeth formed thereon;

(3) a body clutch plate having ratchet teeth formed thereon; and (4) means for mounting said body clutch plate with the blowout preventer against relative rotational movement with respect thereto; and (d) means for urging said ratchet teeth of said body clutch plate and said lock nut clutch plate into engagement to lock said ram carrier means; and (e) means for unlocking comprising cylinder sleeve means mounted in said cylinder enclosing said piston of said ram carrier means;

(f) said cylinder sleeve means responding to opening fluid pressure by engaging said body clutch plate to disable said means for urging and unlock said ram lock;

(g) said locking plug means comprising means for locking said cylinder sleeve means to permit testing of each of said ram lock means without allowing said lock means to become unlocked.

* * * * *